US010279501B2

(12) United States Patent
Strong

(10) Patent No.: US 10,279,501 B2
(45) **Date of Patent: *May 7, 2019**

(54) APPARATUS FOR SEVERING A WORKPIECE

(71) Applicant: California Industrial Rubber Company, Inc., Fresno, CA (US)

(72) Inventor: Gile M Strong, Yuba City, CA (US)

(73) Assignee: California Industrial Rubber Company, Inc., Fresno, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/721,395

(22) Filed: Sep. 29, 2017

(65) Prior Publication Data

US 2018/0021970 A1 Jan. 25, 2018

Related U.S. Application Data

(63) Continuation of application No. 14/827,975, filed on Aug. 17, 2015, now Pat. No. 9,782,907, which is a continuation of application No. 12/069,853, filed on Feb. 12, 2008, now Pat. No. 9,126,349.

(51) Int. Cl.

| | |
|---|---|
| ***B26D 7/06*** | (2006.01) |
| ***B28D 1/24*** | (2006.01) |
| ***B26D 1/18*** | (2006.01) |
| ***B26F 1/38*** | (2006.01) |
| ***B26D 1/157*** | (2006.01) |

(52) U.S. Cl.

CPC ..... *B26D 7/06* (2013.01); *B26D 1/157* (2013.01); *B26D 1/18* (2013.01); *B26F 1/3826* (2013.01); *B28D 1/24* (2013.01); *Y10T 83/6572* (2015.04); *Y10T 83/6651* (2015.04)

(58) Field of Classification Search

CPC . B26D 7/06; B26D 1/157; B26D 1/18; B28D 1/24; B26F 1/3826; Y10T 83/6572; Y10T 83/6651

See application file for complete search history.

(56) References Cited

U.S. PATENT DOCUMENTS

| | | | |
|---|---|---|---|
| 342,127 | A | 5/1886 | Panyard |
| 362,622 | A | 5/1887 | Heiss et al. |
| 669,081 | A | 3/1901 | Fore et al. |
| 1,103,791 | A | 7/1914 | Maimin |
| 1,342,210 | A | 6/1920 | Goldfarb et al. |
| 1,784,337 | A | 12/1930 | Clarke et al. |
| 1,796,463 | A | 3/1931 | Kaltenbach et al. |
| 1,876,075 | A | 9/1932 | Reichert et al. |
| 1,914,528 | A | 6/1933 | Reid et al. |

(Continued)

*Primary Examiner* — Hwei-Siu C Payer

(74) *Attorney, Agent, or Firm* — Thorpe North & Western, LLP; Jared M. Otterstrom

(57) ABSTRACT

An apparatus for severing a workpiece having a cutting mechanism operable to cut the workpiece substantially along a selected course; drive mechanism operable to drive the cutting mechanism to cut the workpiece; a transport assembly operable to guide the workpiece in movement relative to a predetermined severing position and with respect to the cutting mechanism; and a frame mounting the cutting mechanism and transport assembly in predetermined relation to each other and relative to the severing position so that the drive mechanism is operable to drive the cutting mechanism to cut the workpiece in the severing position.

15 Claims, 7 Drawing Sheets

(56) References Cited

U.S. PATENT DOCUMENTS

| | | | | |
|---|---|---|---|---|
| 2,217,923 | A | 10/1940 | Abraham | |
| 2,294,497 | A | 9/1942 | Zawistowski | |
| 2,617,186 | A | 11/1952 | Pickles | |
| 2,627,657 | A | 2/1953 | Etchen | |
| 2,839,103 | A | 6/1958 | Prince et al. | |
| 3,353,266 | A | 11/1967 | Goolsby | |
| 3,791,246 | A | 2/1974 | Lazickas et al. | |
| 3,798,767 | A | 3/1974 | Rizer et al. | |
| 3,812,584 | A | 5/1974 | Peter et al. | |
| 4,024,633 | A | 5/1977 | Stucker et al. | |
| 4,062,111 | A | 12/1977 | Clark et al. | |
| 4,063,480 | A | 12/1977 | Hinzmann et al. | |
| 4,244,102 | A | 1/1981 | Bolles et al. | |
| 4,274,202 | A * | 6/1981 | Petrick | B44C 7/027 30/365 |
| 4,381,605 | A | 5/1983 | Holm et al. | |
| 4,662,069 | A | 5/1987 | Pate et al. | |
| 5,272,949 | A | 12/1993 | Holmes et al. | |
| 6,349,712 | B1 | 2/2002 | Halstead et al. | |
| 6,813,985 | B2 | 11/2004 | Gharst et al. | |
| 9,126,349 | B2 | 9/2015 | Strong | |
| 9,782,907 | B2 * | 10/2017 | Strong | B26D 7/06 |
| 2003/0070306 | A1 | 4/2003 | McDonald et al. | |
| 2015/0352740 | A1 | 12/2015 | Strong | |
| 2018/0021970 | A1 * | 1/2018 | Strong | B26F 1/3826 |

* cited by examiner

APPARATUS FOR SEVERING A WORKPIECE

CROSS-REFERENCE TO RELATED APPLICATIONS

This application claims priority to and is a continuation of the patent application Ser. No. 14/827,975, now U.S. Pat. No. 9,782,907, entitled "APPARATUS FOR SEVERING A WORKPIECE" with filing date Aug. 17, 2015, by Gile M. Strong, and assigned to the assignee of the present invention, the disclosure of which is hereby incorporated herein by reference in its entirety.

This application with Ser. No. 14/827,975 claims priority to and is a continuation of the then co-pending patent application Ser. No. 12/069,853, now U.S. Pat. No. 9,126,349, entitled "APPARATUS FOR SEVERING A WORKPIECE" with filing date Feb. 12, 2008, by Gile M. Strong, and assigned to the assignee of the present invention, the disclosure of which is hereby incorporated herein by reference in its entirety.

STATEMENT REGARDING FEDERALLY SPONSORED RESEARCH OR DEVELOPMENT

Not Applicable.

BACKGROUND OF THE INVENTION

(1) Field of the Invention

The present invention relates to an apparatus for severing a workpiece and, more particularly, to such an apparatus which is unusually well suited to severing a workpiece of a very strong and resistant composition.

(2) Description of the Prior Art

In industry and a variety of other environments, it becomes necessary to sever work materials for a wide variety of purposes. Such severing may require a continuous cutting operation, periodic cutting operations, or a combination of the two. While the work materials themselves dictate the difficulty with which such operations are performed, certain types of materials present particular difficulties.

In many cases, the very composition of the material is designed to resist or prevent severing. In other instances, characteristics such as the resilience of one or more components of the material are of a type resistant to such forces as stress, tension, compression, shearing and the like during normal operation. These characteristics inherently interfere with, or may actually prevent, severing of the material using conventional devices and techniques.

For example, conveyor belts of various types are subject to normal wear as well as damage which makes continued usage in such a condition undesirable or impossible. To avoid such detrimental conditions during operations, conveyor belts are frequently made of thick rubberized materials or other resilient materials, and have multiple laminations, or plies, multiple woven vulcanized layers, or other construction designed to resist such forces and the wear, damage and failure resulting therefrom.

Conventional techniques for aiding in the accomplishment of the severing of such materials have included the use of lubricants and the like during the cutting operation. However, the types of lubricants which conventionally must be used, contaminate and may in themselves attack the material. The high velocity required of conventional severing equipment in contact with the material causes friction creating heat which increases the temperature of the material thereby damaging or otherwise compromising the strength thereof.

Still further, conventional devices must be used in a fixed position or, if movable, are limited in maneuverability during use. In the case of certain materials, these limitations are of little or no consequence. However, in the case of belting of the type described and other such materials, the course along which such severing is desired is not achievable, or at least very difficult, to perform. For example, severing of a conveyor belt is required, or would be preferred, during the splicing of the ends of a belt. The course of such severing would preferably be in a zigzag configuration so that the resulting ends of the belt can be interlocked as a step in the process. This is not possible, or is very difficult, using conventional devices and techniques. In certain instances, the only solution is to use different techniques, or paths of such severing, than would otherwise be desired.

For these and other reasons, it has long been known that it would be desirable to have an apparatus for severing a workpiece which is superior to those which are conventionally available; which is fully capable of severing otherwise durable and resistant work materials; which is fully maneuverable so as to facilitate cutting along any preferred course; which has particular utility in the severing of such work materials as conveyor belts and other very tough and resistant materials rapidly and dependably without the damage associated with the use of conventional devices and techniques; and which is otherwise fully effective in achieving its operational objectives.

BRIEF SUMMARY OF THE INVENTION

Therefore, it is an object of the present invention to provide an improved apparatus for severing a workpiece.

Another object is to provide such an apparatus which can be employed in industry and a variety of other environments to sever work materials which are quite resistant thereto.

Another object is to provide such an apparatus which has particular utility in severing materials which are specifically designed to resist or accommodate such forces as stress, tension, compression, shearing and the like and therefore are very difficult, or impossible, to severe using conventional devices and techniques.

Another object is to provide such an apparatus which is unusually well suited to severing belting, such as conveyor belts and the like, which are constructed to resist the forces and conditions created in such a severing operation.

Another object is to provide such an apparatus which is not static but rather is fully maneuverable so as to be capable of performing a wide variety of severing operations, including those not heretofore possible using conventional devices and techniques.

Another object is to provide such an apparatus which minimizes the amount of heat generated in the workpiece so as to avoid damage resulting therefrom.

Another object is to provide such an apparatus which permits severing of a workpiece along an intricate path of travel without being hindered by the composition of the workpiece during such operation.

Another object is to provide such an apparatus which can readily be employed in achieving its operational objectives.

Another object is to provide such an apparatus which is of uncomplicated construction and operation while operating with a precision not heretofore achieved in the art.

Further objects and advantages are to provide improved elements and arrangements thereof in an apparatus for the purposes described which is dependable, economical, durable and fully effective in accomplishing its intended purposes.

These and other objects and advantages are achieved, in the preferred embodiment of the present invention, in an apparatus for severing a workpiece comprising a cutting mechanism operable to cut the workpiece substantially along a selected course; a drive mechanism operable to drive the cutting mechanism to cut the workpiece; a transport assembly operable to guide the workpiece in movement relative to a predetermined severing position and with respect to the cutting mechanism; and a frame mounting the cutting mechanism and transport assembly in predetermined relation to each other and relative to the severing position whereby the drive mechanism is operable to drive the cutting mechanism to cut the workpiece in the severing position.

DETAILED DESCRIPTION OF THE INVENTION

Figure 1:
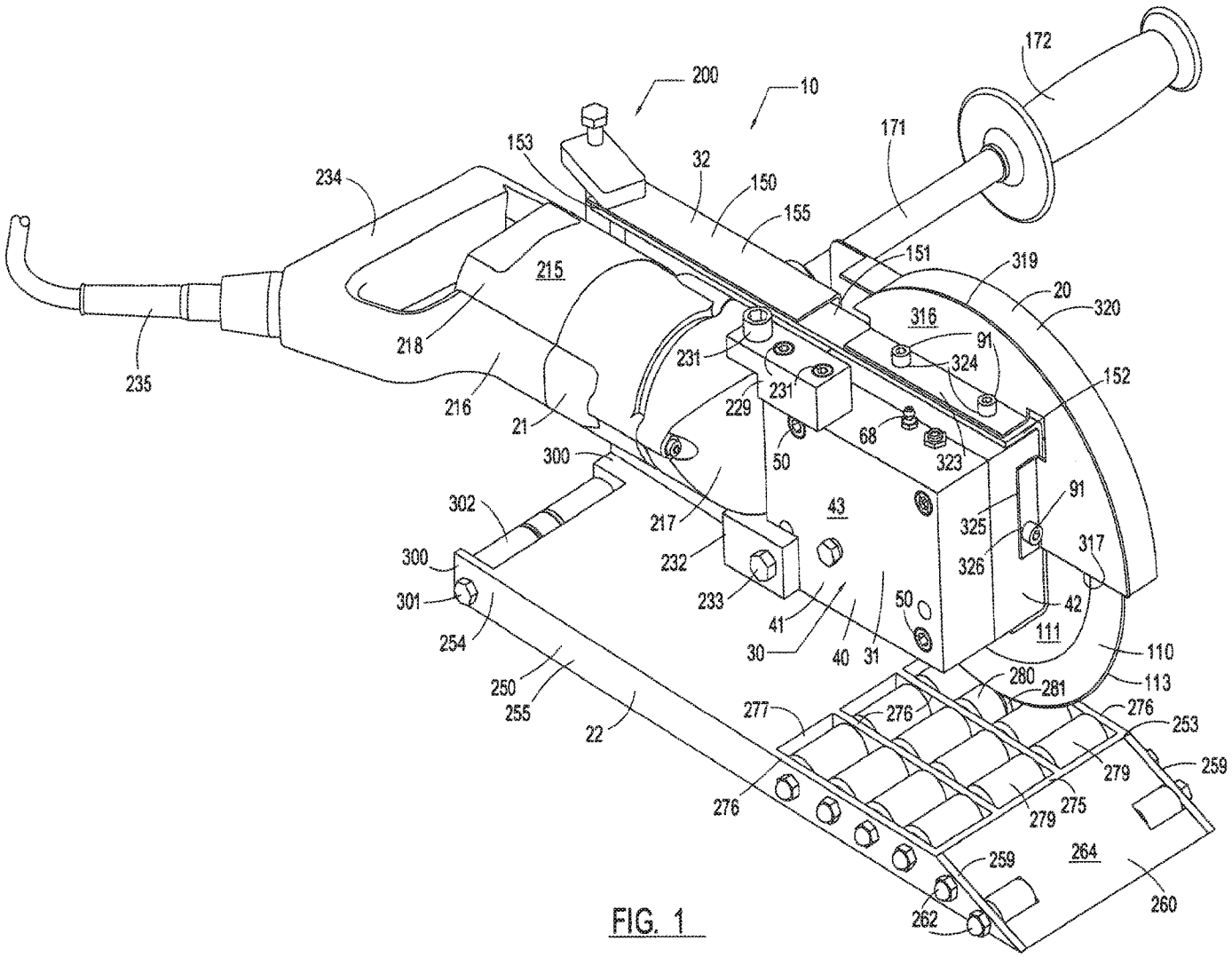
FIG. 1 is a perspective view of the front of the apparatus of the present invention showing the right side thereof.

Referring more particularly to the drawings, the apparatus for severing a workpiece of the present invention in generally indicated by the numeral 10 in FIG. 1.

The apparatus 10 can generally be viewed as having a forward severing assembly 20, a rearward driving assembly 21 and a lower feeding assembly 22. These assemblies are, perhaps, best shown in FIGS. 1 and 2 in their respective operative positions relative to each other.

Figure 7:
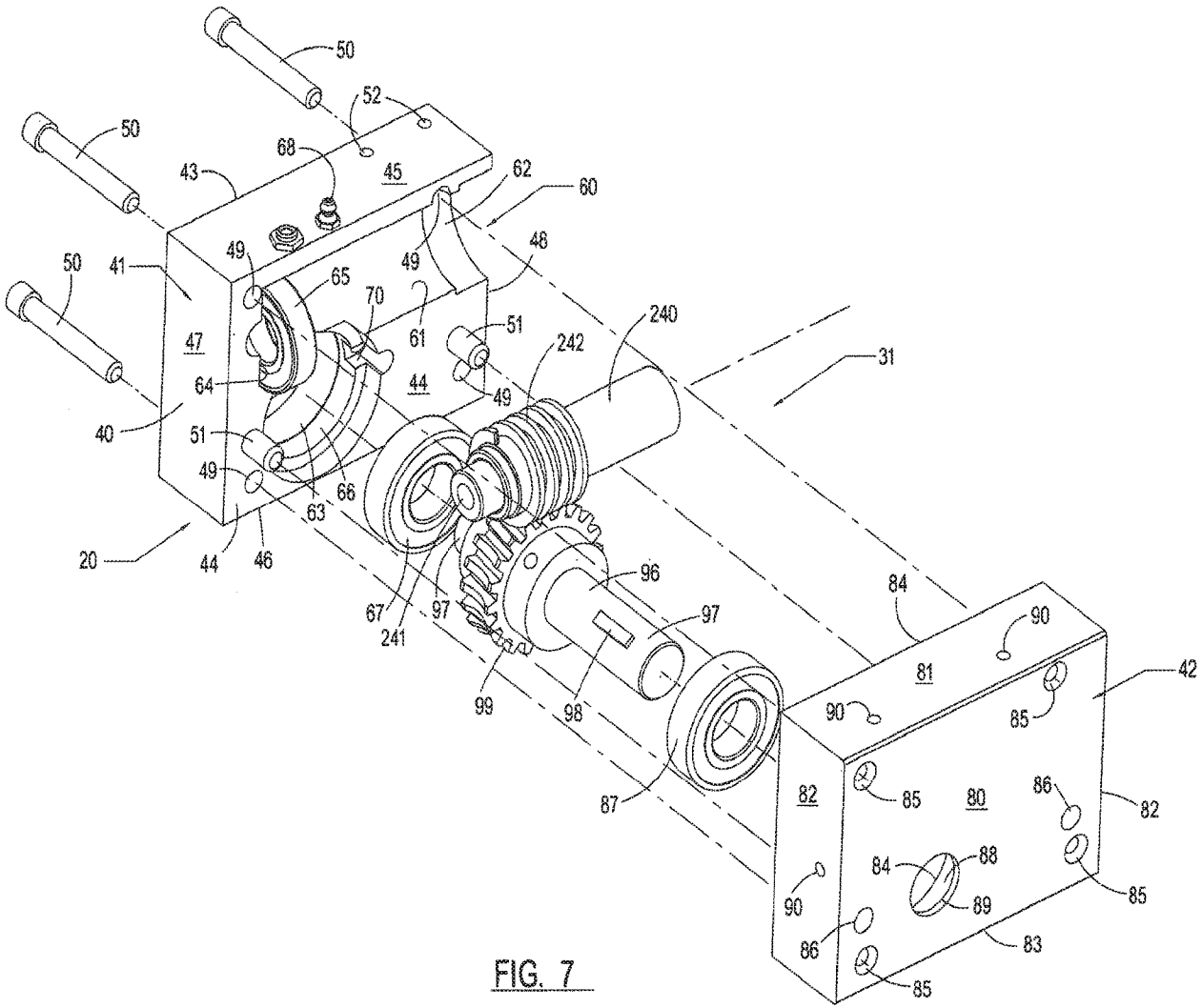
FIG. 7 is an exploded perspective view of the transmission assembly of the apparatus shown principally from the left side thereof as viewed in FIG. 6.

The forward severing assembly 20 has a main housing 30 including a transmission assembly 31 and a mounting assembly 32. The transmission assembly has a transmission housing 40 having a first case 41 and a second case 42 mounted in facing engagement with respect to each other. As shown in FIG. 7, the first case has a flat outer surface 43 and a substantially parallel interior surface 44. The first case has an upper surface 45, a lower surface 46, a forward surface 47 and a rearward surface 48.

The first case 41 has four (4) bolt holes 49 which extend through the first case from the outer surface 43 through the interior surface 44 in predetermined positions, as shown in FIG. 7. The bolt holes are dimensioned individually to receive four (4) securing bolts 50. Two (2) alignment studs 51 are extend outwardly from the interior surface 44 in predetermined positions, as shown in FIG. 7. Two (2) internally screw threaded bolt holes 52 extend into the upper surface 45 of the first case in the predetermined positions shown in FIG. 7.

The first case 41 has a transmission compartment generally indicated by the numeral 60 in FIG. 7. The transmission compartment extends inwardly of the first case from the interior surface 44 along an axis substantially parallel to the upper surface 45. The transmission compartment has a substantially cylindrical drive shaft chamber 61 extending inwardly thereof from the rearward surface 48 through an opening 62. The drive shaft chamber communicates with a bearing chamber 63 within the first case. The bearing chamber has a first bearing seat 64 aligned with the drive shaft chamber and within which is mounted a first bearing assembly 65. The bearing chamber has a second bearing seat 66 right angularly related to the drive shaft chamber and within which is mounted a second bearing assembly 67. A lubrication fitting 68 is mounted on the upper surface 45 and communicates with the drive shaft chamber 61.

A bearing mounting slot 70 extends from the interior surface 44 into the first case 41 beneath the drive shaft chamber 61, as shown in FIG. 7. The second bearing mounting slot is dimensioned to receive a key, not shown, mounted on the second bearing assembly 67. When the second bearing assembly is mounted in the second bearing seat 66, the key is received in the bearing mounting slot. This prevents outer housing of the second bearing assembly itself from being rotated about its longitudinal axis when the apparatus 10 is operated.

The second case 42 has an outer wall 80, an upper surface 81, two (2) side walls 82 and a lower wall 83. The outer wall, upper wall, side walls and lower wall bound an interior wall 84. The outer surface 80 has four (4) internally screw threaded bolt holes 85 extending therethrough in positions corresponding to those of the bolt holes 49 of the first case 41. The second case is mounted on the first case with the interior surfaces 44 and 84 thereof disposed in facing engagement. The first case and second case are retained in such facing engagement by the securing bolts 50 individually extending through their respective bolt holes 49 of the first case and screw threadably received in the bolt holes 85 of the second case. The alignment studs 51 are operable to guide movement of the first and second cases into this position by individually being extended into guide holes 86.

The second case 42 mounts a third bearing assembly 87 in a third bearing seat 88. The third bearing assembly is disposed in alignment with a shaft hole 89 extending through the outer wall 80 of the second case. Internally screw threaded mounting holes 90 extend into the upper wall 81 and left side wall 82 on the left as viewed in FIGS. 6 and 7 of the second case. As will hereinafter be described in greater detail, bolts 91 are individually screw threadably received in the mounting holes 90 of the side wall 82 on the left, as viewed in FIGS. 6 and 7, and the upper wall 81.

A transverse drive shaft 96 is received for rotational movement about its longitudinal axis in the second bearing assembly 67 and the third bearing assembly 87. The transverse drive shaft has opposite end portions 97. The opposite end portion on the left, as viewed in FIG. 7, is mounted for rotational movement in the second bearing assembly 67. The central portion of the transverse drive shaft is received for rotational movement in the third bearing assembly 87. The opposite end portion of the transverse drive shaft on the right, as viewed in FIG. 7, extends from the third bearing assembly outwardly of the second case 42 through the shaft hole 89. A key 98 is mounted on the transverse drive shaft externally of the second case. A radially extending transverse drive shaft gear assembly 99 is mounted on the transverse drive shaft adjacent to the opposite end portion 97 on the left, as shown in FIG. 7. The transverse drive shaft gear assembly is mounted in fixed position on the transverse drive shaft for rotation therewith.

The forward severing assembly 20 has a cutting blade assembly 110. The cutting blade assembly has a circular, substantially flat central plate 111 circumscribed by a radially extending cutting blade 112. The cutting blade extends outwardly to a circular cutting edge 113. The cutting blade assembly has a central hub 114 mounted on and extending outwardly from the central plate concentric to the cutting edge 113. The central hub has a shaft passage 115 extending therethrough concentric to the central hub and having a radially extending keyway 116. The keyway is dimensioned slidably to receive the key 98 of the transverse drive shaft 96. The transverse drive shaft and cutting blade assembly are interlocked in fixed position with the transverse drive shaft disposed in driving relation to the cutting blade assembly.

Figure 6:
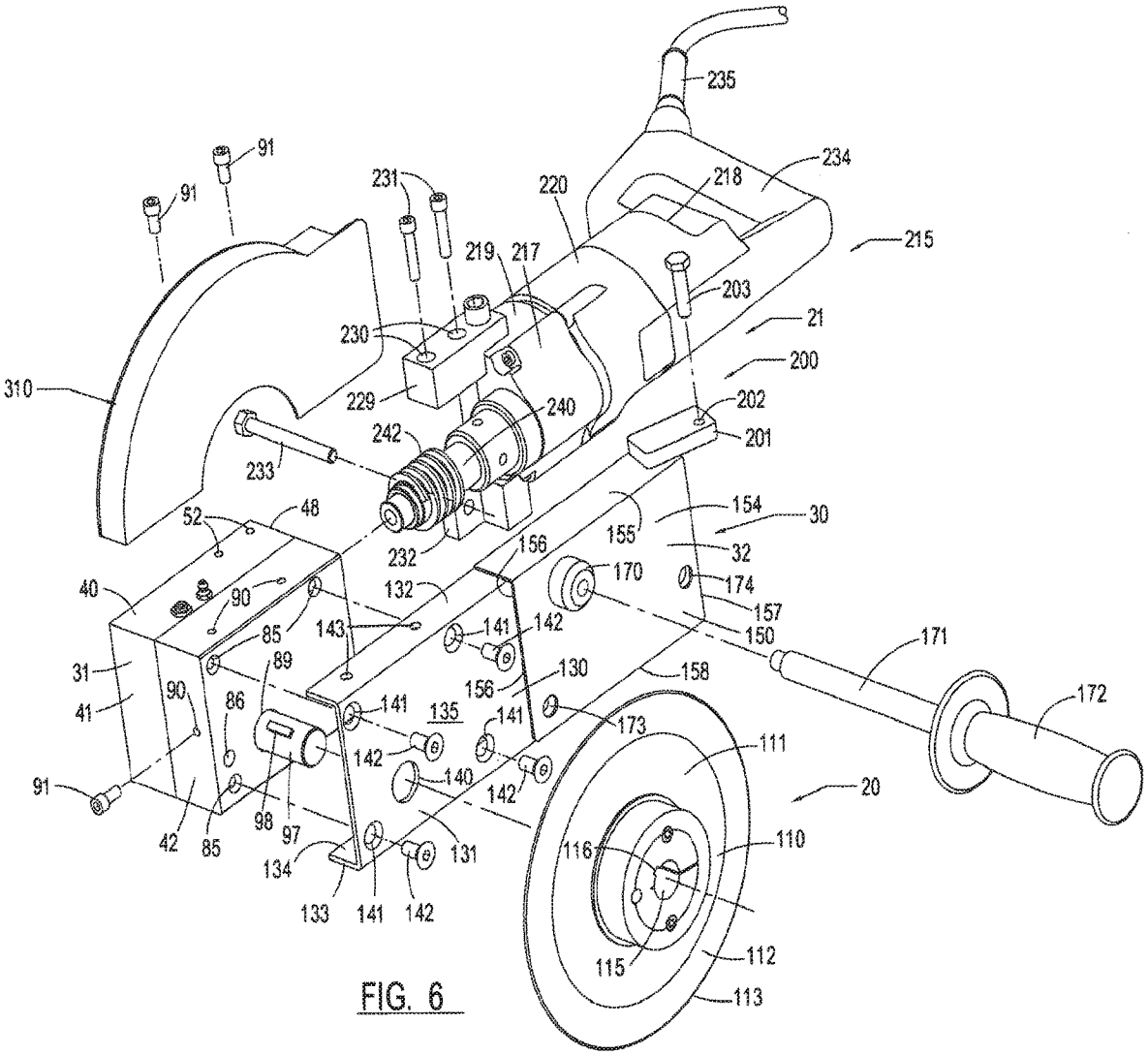
FIG. 6 is an exploded perspective view of the apparatus shown principally from the left side thereof.

The mounting assembly 32 is mounted on the apparatus 10 between the second case 42 and the cutting blade assembly 110, as best shown in FIG. 6. The mounting assembly has a primary housing 130 which has a substantially flat back plate 131, a top plate 132 and a bottom plate 133. The top plate and bottom plate are disposed in substantially parallel relation to each other and at right angles to the back plate. The back plate, top plate and bottom plate have interior surfaces 134 and exterior surfaces 135. The interior surfaces of the back plate, top plate and bottom plate are mounted in facing engagement with corresponding outer wall 80, upper wall 81 and lower wall 83 of the second case. The back plate 131 of the primary housing 130 has a drive shaft passage 140 through which the end portion 97 of the transverse drive shaft 96 extends. Two (2) mounting holes 143 extend through the top plate 132 and bottom plate 133 of the primary housing. Four (4) bolt holes 141 extend through the back plate 131 in the positions shown in FIG. 6 in individual alignment with the bolt holes 85 of the second case 42. Four (4) mounting bolts 142 are individually extended through the bolt holes 141 and individually screw threadably received in the bolt holes 85 of the second case to mount the primary housing 130 in the described position on the second case. Similarly, the bolts 91 extend through bolt holes 143 of the top plate 132 of the primary housing 130 and are screw threadably received in the bolt holes 90 of upper surface of 81 of the second case 42.

The mounting assembly 32 has a secondary housing 150 mounted on the primary housing 130 by means of an angle iron support beam 151. The angle iron support beam has a front end 152 and a rear end 153. The angle iron support beam is mounted on the primary housing, as best shown in FIG. 1, by being captured on the top plate 132 of the primary housing by the bolts 91 extending through holes, not shown, in the portion of the support beam adjacent to the front end thereof. The bolts 91 are individually extended through the bolt holes 143 and screw threadably received in their respective mounting holes 90. The secondary housing has a back plate 154 and a top plate 155. The back plate and the top plate have front edges 156 and rear edges 157. The back plate has a lower edge 158. The top plate 155 is mounted, by any suitable means, on the support beam adjacent to rear end 153 thereof.

The back plate 154 has mounted thereon an internally screw threaded arm mount 170. A control arm 171 is screw threadably received in the arm mount so as to be mounted in fixed position therein and relative to the secondary housing 150. A handle 172 is mounted on the distal end portion of the control arm. A forward hole 173 extends through the back plate adjacent to the front edge 156 and the lower edge 158 thereof. A rearward hole 174 extends through the back plate adjacent to the rear edge 157 and lower edge 158 thereof.

Figure 2:
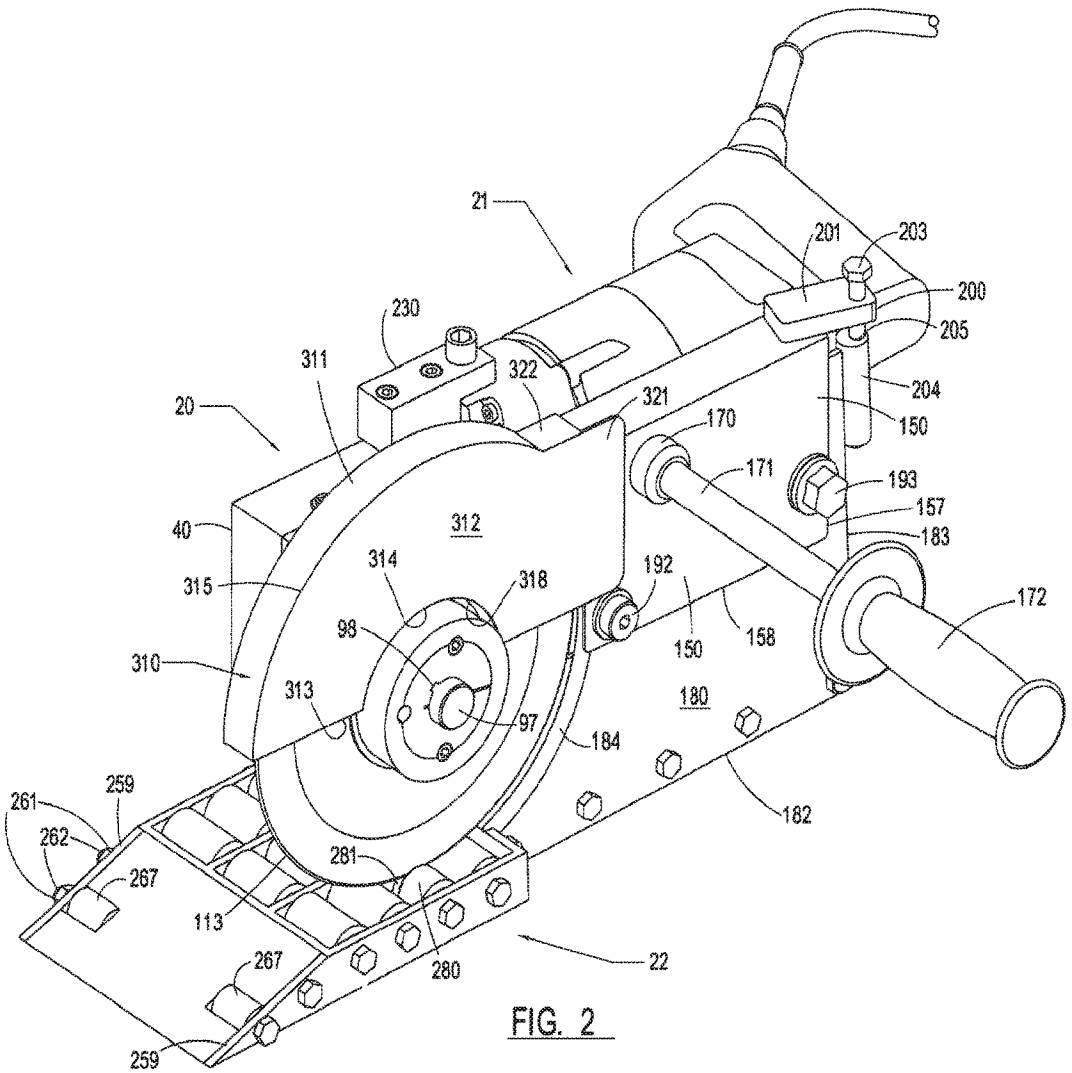
FIG. 2 is a perspective view of the front of the apparatus showing the left side thereof opposite to the side shown in FIG. 1.

A guide plate 180 is mounted on the back plate 154 of the secondary housing 150 between the back plate 154 and the interior of the apparatus 10, as perhaps best shown in FIG. 2. The guide plate has an upper edge 181 and an opposite lower edge 182. The guide plate has a rearward edge 183 and an arcuate forward edge 184 having a substantially vertical lower portion 185. Preferably, although not necessarily, the arcuate forward edge 184 is of a tapered or sharpened configuration for reasons subsequently to be discussed. The guide plate has a forward hole 190 extending therethrough. A pivot pin assembly 192 is mounted on the back plate 154 of the secondary housing 150 within the forward hole 173 of the back plate and extends through the forward hole 190 of the guide plate. The pivot pin assembly is selectively operable to release to permit adjustment of the forward severing assembly 20 about the axis thereof and, alternatively to lock the severing assembly in a selected fixed position relative to the pivot pin assembly. A locking bolt assembly 193 is mounted on the back plate 154 within the rearward hole 174 and through the rearward arcuate slot 191. The locking bolt assembly is selectively operable to release the guide plate for movement of the locking bolt assembly within the rearward arcuate slot to permit pivotal adjustment of the guide plate about the axis of the pivot pin assembly and to lock the severing assembly in fixed position in the position selected.

Figure 4:
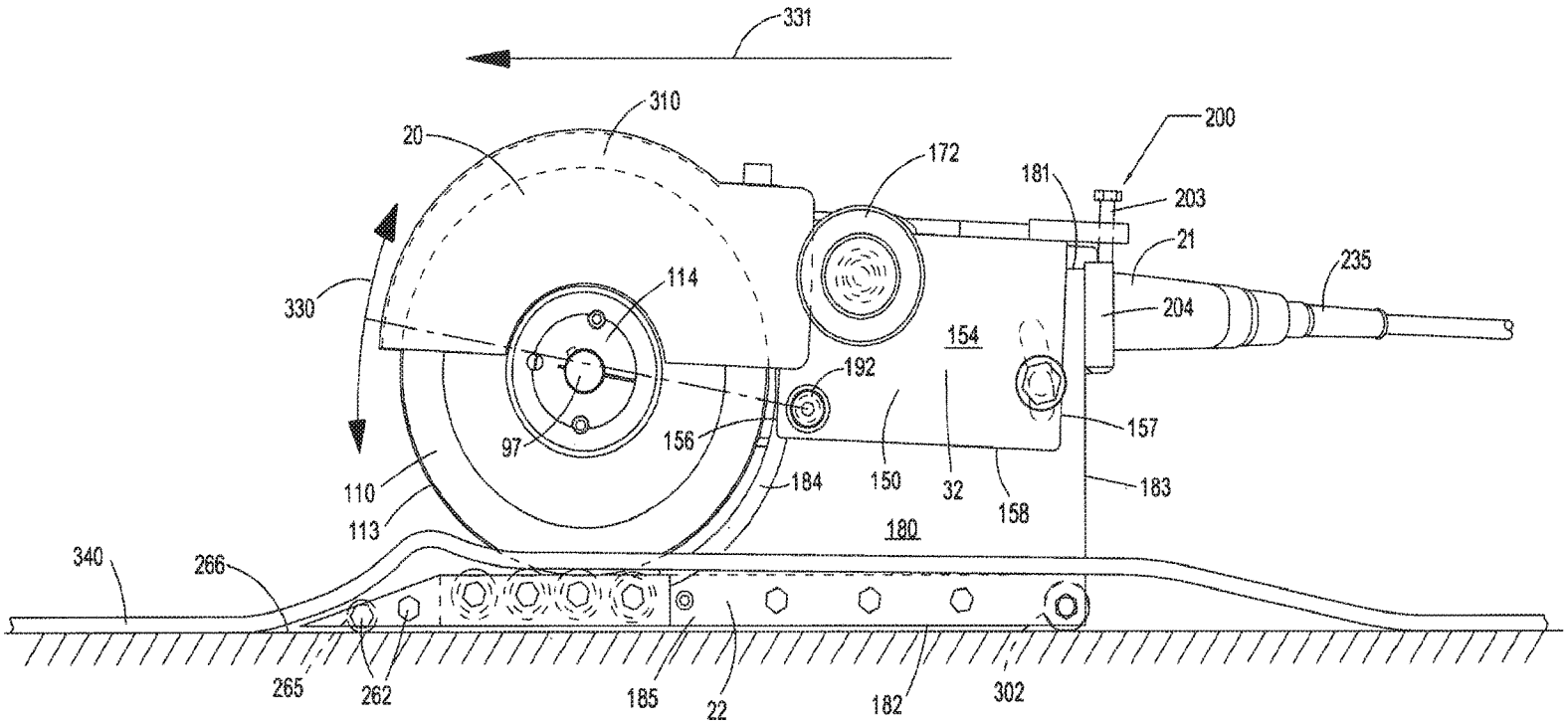
FIG. 4 is a side elevation of the apparatus shown in the same operative environment as that of FIG. 3.

A support assembly 200 is mounted on and interconnects the secondary housing 150 and the guide plate 201 mounted, as by welding, on the top plate 155 of the secondary housing adjacent to the rear edge 157 thereof. The mounting plate has an internally screw threaded hole 202 extending therethrough in the position shown in FIG. 6. A screw threaded adjustment bolt 203 is screw threadably received in the screw threaded hole 202 for substantially vertical adjustment therewithin. An adjustment cylinder 204 is mounted, as by welding, on the rearward edge 183 of the guide plate 180. The adjustment cylinder has an internally screw threaded bolt hole 205 extending longitudinally of the adjustment cylinder. The distal end portion of the adjustment bolt 203 is screw threadably received in the bolt hole 205, as best shown in FIG. 4. It will be seen that vertical movement of the adjustment bolt in either direction, when the locking bolt assembly 193 is loosened, moves the locking bolt assembly upwardly or downwardly in the rearward arcuate slot 191 to allow such vertical adjustment of the guide plate about the pivot pin assembly 192. The locking bolt assembly 193 is then tightened to lock the guide plate in the selected position.

The rearward driving assembly 21 of the apparatus 10 has an electrically powered drive unit 215 best shown in FIGS. 1 and 6. The drive unit has a main housing 216 having, generally, a forward portion 217 and an electrical assembly 220 mounted thereon in driving relation to the transmission assembly.

The drive unit 215 has an upper mount 229 mounted on and interconnecting the first case 41 of the transmission housing 40 and the forward portion 217 of the main housing 216 of the drive unit. The drive unit has three (3) bolt holes 230. The upper mount 229 has three (3) mounting bolts 231 which individually extend through the bolt holes 230 and are screw threadably received in the bolt holes 52. A lower mount 232 is mounted on and interconnects the first case and the forward portion of the main housing 216 by bolts 233. The rearward portion 218 of the main housing 216 mounts a gripping handle 234 to which is connected an electrical power cord 235. The power cord has a terminal end, not shown, adapted for connection to a source of electrical energy, not shown.

The transmission assembly 219, at the forward portion 217 of the main housing 216, mounts a drive shaft 240 extending axially therefrom. The drive shaft extends to a terminal end portion 241. The drive shaft is rotational about its longitudinal axis by the transmission assembly 219. A worm gear 242 is mounted on and extended about the terminal end portion 241 of the drive shaft. The drive shaft, as best shown in FIG. 7, is mounted for rotational movement in the first bearing assembly 65 extending into the transmission compartment 60 through the opening 62 thereof. The worm gear engages the transmission drive shaft gear assembly 99 in driving engagement therewith.

Figure 5:
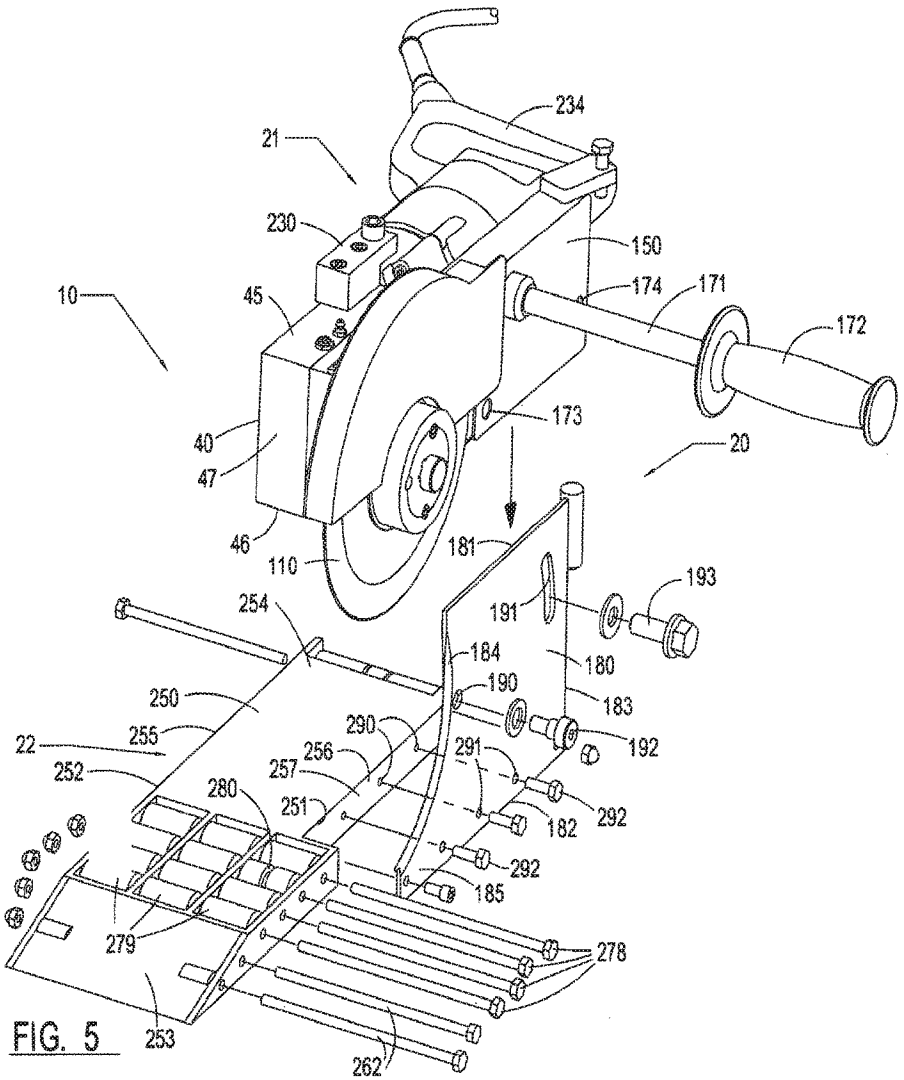
FIG. 5 is an exploded perspective view of the apparatus shown principally from the front thereof.

Referring more particularly to FIG. 5, the lower feeding assembly 22 has a frame 250 which is mounted on the guide plate 180. The frame has a left side 251 and a substantially parallel right side 252. The frame has a forward portion 253 and an opposite rearward portion 254.

The right side of the frame 250 has a right sidewall 255 extending the length of the right side of the frame. The left side of the frame has a left sidewall 256 which extends the length of the left side of the frame. The left side of the frame has a recessed portion 257 extending to the rearward portion of the frame, as best shown in FIG. 5. The frame 250, at the forward portion 253 thereof, has a pair of upwardly sloped side arms 259. The side arms are substantially parallel to each other and have an upwardly sloped ramp plate 260 mounted therebetween by any suitable means. The ramp plate is preferably, although not necessarily, made of a material having low coefficient of friction, such as ultra high molecular weight polyethylene. Two (2) nut and bolt assemblies 261 extends through the side arms beneath the ramp plate. Two (2) axle assemblies 262 extends through the side arms beneath the ramp plate. The ramp plate and the side arms define a leading edge 263 and a ramp surface 264 extending upwardly and rearwardly therefrom at a sloped angle.

Front support rollers 265 are mounted for rotational movement about the axle assembly 262. The front support rollers have an outer periphery which extends a short distance below the frame 250 and the guide plate 180. The front support rollers are thus adapted for rolling engagement with a supporting surface, such as support surface 266. The front support rollers are preferably, although not necessarily constructed of nylon.

Two (2) rectangular openings are formed in the ramp plate 260 extending through the ramp surface 264 individually adjacent to the sloped side arms 259, as best shown in FIGS. 1 and 2. The front support rollers 265 individually extend through and a short distance above the ramp surface 264.

The ramp surface 264 extends upwardly and rearwardly into communication with a transverse frame member 275 of the frame 250. The frame has four (4) spaced, substantially parallel longitudinal frame members 276 mounted on and extending between the main body of the frame and the transverse frame member. Adjacent longitudinal frame members 276 define equally dimensioned, longitudinal openings 277, as best shown in FIG. 1. Four (4) nut and bolt assemblies 278 are mounted on and extend transversely between the longitudinal frame members. Four (4) feed rollers 279 are individually mounted on the nut and bolt assemblies 278 within each longitudinal opening 277 for rotational movement about the nut and bolt assemblies, as best shown in FIGS. 1 and 5. The feed rollers are preferably, although not necessarily, constructed of nylon. The feed rollers are positioned so as to be spaced from and thereby not engage the support surface 266, as shown in FIG. 4. A severing roller 280 is mounted for rotational movement directly beneath the cutting edge 113 of the cutting blade 112. A slot 281 extends about the periphery of the severing roller. The slot is substantially U-shaped in cross section and the cutting edge 113 of the cutting blade 112 extends into the slot 281. The severing roller is preferably, although not necessarily, constructed of brass. The slot is dimensioned to receive the cutting edge 113 of the cutting blade 112 without direct contact therewith.

The left sidewall 256 has four (4) screw threaded bolt holes 290 extending therethrough in equally spaced relation adjacent to the lower edge thereof. The guide plate 180 has four (4) corresponding bolt holes 291 extending therethrough adjacent to the lower edge 182. The left sidewall is mounted on the guide plate by four (4) bolts 292 individually extending through the bolt holes 291 and screw threadably received in the bolt holes 290. The frame 250 of the lower feeding assembly 22 is thereby mounted in depending relation on the guide plate spaced from the forward severing assembly 20.

The rearward portion 254 of the frame 250 has two (2) rearwardly extending mounting arms 300 disposed in spaced, substantially parallel relation. An axle assembly 301 is mounted on and extends between the mounting arms transversely of the frame. A rear support roller 302 is mounted on the axle assembly for rotational movement thereabout. The rear support roller has an outer periphery which extends a short distance below the frame 250 and guide plate 180, as shown in FIG. 4. Thus, the apparatus 10 of the present invention is operable for rolling engagement with the support surface 266 on the front support roller 265 and rear support roller 302.

A blade shield assembly 310 is mounted on the second case 42 of the transmission housing 40, as best shown in FIG. 1. The blade shield assembly has a blade shield housing 311 having a front plate 312. The front plate has a lower edge 313 having a central hub opening 314 positioned and dimensioned in accordance with predetermined specifications so as to extend in predetermined spaced relation to the central hub 114 of the cutting blade assembly 110. The front plate has an arcuate upper edge 315.

The blade shield housing 311 has a back plate 316 having a lower edge 317 which, in turn, has a central hub opening 318. The back plate has an arcuate upper edge 319. The upper edge 315 of the front plate 312 and the upper edge 319 of the back plate are interconnected by a peripheral plate 320 mounted on and interconnecting the upper edges, as shown in the drawings. The front plate has a rearwardly extending rear portion 321 joined with a rearwardly extending rear portion 322 of the peripheral plate.

An upper bracket 323 is mounted on and extends from the back plate 316 of the blade shield housing 311. The upper bracket has two (2) bolt holes 324 extending therethrough in predetermined positions matching those of the bolt holes 90. This is accomplished by the bolts 91 individually extending through the corresponding bolt holes 324 and 90 and screw threadably mounted in the bolt holes 90. Two (2) side brackets 325 are mounted on and extend from the back plate 316 of the blade shield housing 311. The side brackets each have one (1) bolt hole 326 extending therethrough. A bolt 91 is extended through the bolt hole of each side bracket and screw threadably received in its respective mounting hole 90 of the second case 42 thereby mounting the blade shield housing 311 on the second case, as best shown in FIG. 1.

As shown in FIG. 4, the blade shield assembly 310 is pivotal for adjustment thereof by loosening the pivot pin assembly 192, the locking bolt assembly 193 and the guide plate adjustment assembly 200. The guide plate 180, the cutting blade assembly 110 and the transmission assembly 40 can then be pivoted to a new position about the pivot pin assembly 192 and indicated by arrows 330 in FIG. 4. The pivot pin assembly 192, locking bolt assembly 193 and guide plate adjustment assembly 200 are then again tightened to retain these portions of the apparatus 10 in the newly selected position.

Figures 3, 8:
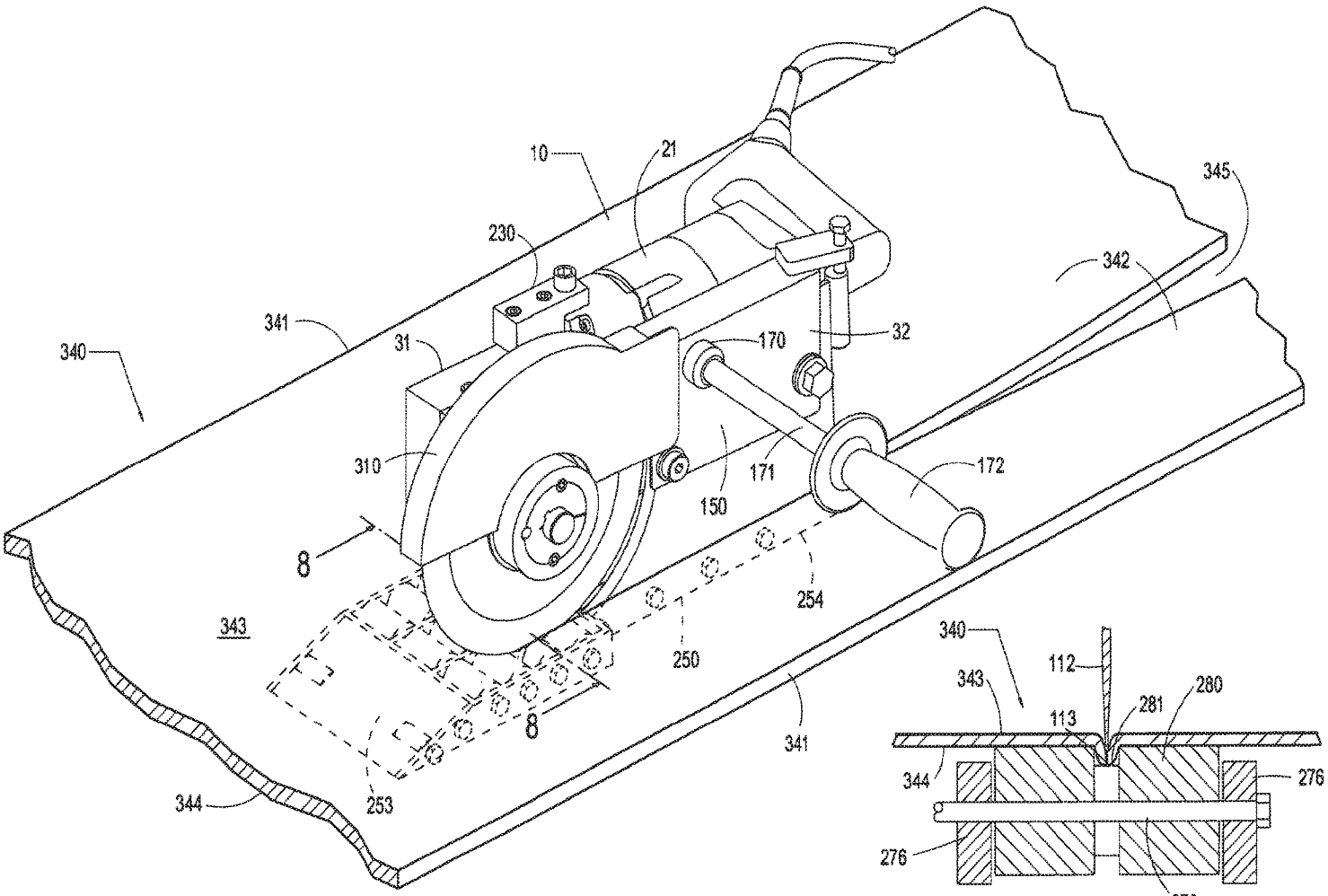
FIG. 3 is a perspective view of the front of the apparatus shown in a typical operative environment.
FIG. 8 is a somewhat enlarged transverse vertical section taken on line 8-8 in FIG. 3.

In FIG. 4, the arrow 331 indicates the normal direction of travel of the apparatus 10 during use. Referring more particularly to FIGS. 3 and 4, the apparatus 10 is shown in a particular operational environment wherein a workpiece 340 is rested on the support surface 266. The workpiece, in the example provided for illustrative convenience, is a substantially continuous conveyor belt having opposite side edges 341 and showing the severed portions of the workpiece indicated by the numeral 342 in FIG. 3. The workpiece has an upper surface 343 and a lower surface 344. As also shown in FIG. 3, the severed portions 342 of the workpiece 340 are separated by a severed gap 345.

Operation

The operation of the described embodiment of the subject invention is believed to be clearly apparent and is briefly summarized at this point.

In order to place the apparatus 10 in operable condition, the electrical power cord 235 is plugged into an electrical outlet, not shown. This, of course, supplies electrical energy to the drive unit 215 making it available for operation. The particular workpiece 340 which, in the illustrative example hereof, is a conveyor belt, a portion of a conveyor belt, or the like, is positioned on the support surface 266 in the attitude most convenient for the specific cutting operation to be performed.

Again, only for illustrative convenience, it will be understood that the workpiece 340 is to be severed along a course longitudinally of the workpiece, as depicted in FIGS. 3 and 4. The apparatus 10 is positioned with the front transport roller 265 and rear transport roller 302 in rested rolling engagement with the support surface 266. The end of the workpiece, not shown, at which the severing operation is to begin is placed in rested relation on the ramp surface 264 and feed rollers 279 against the cutting edge 113 of the cutting blade 112. The workpiece is so positioned relative to the apparatus that the cutting blade is precisely aligned with the longitudinal course along which such severing is to be performed. This may be demarcated with an inscribed line on the workpiece or the like.

The operator grasps the gripping handle 234 of the drive unit 215 with one hand and the handle 172 of the control arm 171 with the other hand. The drive unit 215 is then turned on using a switch, not shown. This causes electrical energy to pass through the electrical power cord 235 from the source of electrical energy to power the drive unit 240. Referring to FIGS. 6 and 7, the drive unit rotates the drive shaft 240 in a clockwise direction of rotation, as viewed therein, in the first bearing assembly 65. This causes the worm gear 242 to be rotated in the same clockwise direction of rotation. The worm gear thereby rotates the transverse drive shaft gear assembly which it engages to be rotated in counterclockwise direction of rotation, as viewed in FIG. 7. The transverse drive shaft 96 is thereby caused to be rotated in the same counterclockwise direction of rotation in the second bearing assembly 67 and third bearing assembly 87.

The cutting blade assembly 110 mounted on the opposite end portion 97 of the transverse drive shaft 96, interlocked therewith by virtue of the engaged key 98 and key way 116, is thereby similarly rotated in a counterclockwise direction of rotation, as viewed in FIG. 6. As best shown in FIGS. 3 and 4, this direction of rotation causes the cutting edge 113 of the cutting blade 112 to cut through the end of the workpiece 340 as a result of the operator moving the apparatus and thus the cutting edge of the cutting blade thereacross and along the course. This draws the workpiece continuously into the cutting edge of the cutting blade along the course. More specifically, the starting portion of the workpiece trailing the starting end is continuously drawn up the ramp surface 264, over the feed rollers 279 and into the cutting edge of the cutting blade to be severed, as shown in FIG. 3. The operator, grasping the gripping handle 234 and handle 172, simply guides the cutting edge of the cutting blade along the desired course applying such force to the apparatus to move the cutting edge along the course as is desired. Since the apparatus is supported by the front support roller 265 and rear support roller 302 on the support surface 166, the apparatus can be moved along the desired course with minimal effort.

Since the apparatus 10 is constructed as described, the apparatus is very maneuverable so as to be capable of cutting a workpiece along virtually any course. Such maneuverability, for example, permits severing of a conveyor belt transversely thereof along a zigzag course to facilitate splicing of the belt.

Since the front support roller 265 and rear support roller 302 are, in each case, rollers which extend substantially the full width of the frame 250 of the lower feeding assembly 22, the apparatus is securely maintained in a balanced upright attitude transversely of the apparatus as shown in the drawings. Similarly, since the rollers are at the opposite ends of the frame, the apparatus can be moved along the described path of travel without any instability, or rocking motion, longitudinally of the apparatus.

The cutting edge 113 of the cutting blade extends into and is rotated within the slot 281, of the brass severing roller 280 as shown in FIGS. 1 and 2. The slot, as previously discussed, is preferably U-shaped in cross section. The cutting edge 113 of the cutting blade 112 rotates within the slot of the brass severing roller 280, but does not touch the sides or bottom of the slot nor in any other respect contact the cutting brass roller. This interoperation of the cutting edge of the cutting blade and the slot of the brass severing roller causes the workpiece to be pressed into the slot during movement therebetween. The workpiece is sheared to form the severed portions 342 and the severed gap 345 therebetween, as best shown in FIG. 3. This relationship insures that the workpiece is severed entirely through during the severing operation.

Since the mounting assembly 32 is constructed as heretofore described, the drive unit 215 of the rearward driving assembly 21 and the cutting blade assembly 110 of the forward severing assembly 20 are mounted on the mounting assembly in the described fixed relation to each other. Thus, no adjustment of the drive unit and the cutting blade assembly relative each other is ever required. Consequently, the optimum operational relationship of these components at the time of manufacture and assembly is maintained.

Nonetheless, the drive unit 215 and the cutting blade assembly 110 can be adjusted, as a unit, relative to the lower feeding assembly 22. This capability can best be visualized upon reference to FIGS. 1, 2 and 4. While at the time of manufacture and assembly, the optimum relationship of these components is preset, there are conditions under which this preset relationship should be adjusted. Such conditions, for example, include a greater or lesser thickness for the workpiece which is to be severed; the course along which such severing is to be achieved; the resistance of the workpiece to be severed; the condition of the cutting edge of the cutting blade assembly, for example, new, worn or damaged; the speed at which such severing is to be performed; and the like.

This adjustment of the drive unit 215 and cutting blade assembly 110 relative to each other can best be visualized upon reference to FIG. 4. The pivot pin assembly 192 is loosened to release the guide plate 180 and therefor the components borne thereby; that is; the device unit 215 and cutting blade assembly 110; for pivotal movement about the pivot pin assembly. At the same time, the locking bolt assembly 193 is loosened in the rearward arcuate slot 191 and the screw threaded adjustment bolt loosened to permit the desired adjustment. As shown in FIG. 4, the guide plate with the components borne thereby are pivoted upwardly or downwardly about the pivot pin assembly along the range of movement indicated by the arrows 330 in FIG. 4. When the desired adjustment has been achieved, the pivot pin assembly 192, locking bolt assembly 193 and guide plate adjustment assembly 200 are tightened to retain the guide plate and the components borne thereby in the new adjusted position.

Therefore, the apparatus for severing a workpiece of the present invention is superior to those which are conventionally available; is fully capable of severing otherwise very durable and resistant work materials; is fully maneuverable so as to facilitate cutting along any desired course; has particular utility in the severing of such work pieces as conveyor belts and other such very resistant materials rapidly and dependably without the damage associated with the use of conventional devices and techniques; and is otherwise fully effective in achieving its operational objectives.

Although the invention has been herein shown and described in what is conceived to be the most practical and preferred embodiment, it is recognized that departures may be made therefrom within the scope of the invention which is not to be limited to the illustrative details disclosed.

What is claimed:

1. An apparatus for severing a workpiece of a strong and resistant composition, said apparatus comprising:

a severing blade operable to cut said workpiece substantially along a selected course at a severing position;

a frame mounting said severing blade relative to said severing position;

a guide plate mounted vertically in a plane with said severing blade; and a slotted rotational member mounted directly below said severing blade and having a slot extending substantially circumferentially about said slotted rotational member and positioned to receive a periphery of said severing blade therewithin without directly contacting said severing blade during a rotational movement of said severing blade.

2. The apparatus of claim 1 wherein said workpiece is rested on a supporting surface and said apparatus further comprising a transport assembly having at least one rolling member mounted thereon and engageable with said supporting surface to support said apparatus for movement on said supporting surface along said workpiece that is rested upon the supporting surface to pass through said severing position to cut said workpiece.

3. The apparatus of claim 2 wherein said at least one rolling member comprises at least two rolling members individually mounted on said transport assembly on a forward portion and on a rearward portion thereof and said rolling members extend substantially transversely of said transport assembly whereby said apparatus is substantially stable longitudinally and transversely during said movement on said supporting surface along said workpiece.

4. The apparatus of claim 3 wherein said transport assembly has a platform extending between said forward portion and said rearward portion of said transport assembly through said severing position and a ramp is mounted on said forward portion of said transport assembly operable to feed said workpiece on said platform forwardly of said severing position.

5. The apparatus of claim 4 wherein a plurality of rotational members are mounted on said platform extending substantially transversely of said platform beneath said severing position operable to engage said workpiece therebeneath to assist said movement of said workpiece through said severing position and over said platform during a cutting operation.

6. The apparatus of claim 1 wherein said severing blade is driven by a drive in rotational movement through said severing position and said workpiece is pressed into said slot by said severing blade during a cutting operation providing resistance to said severing blade to assist in severing said workpiece.

7. The apparatus of claim 1 wherein said slot is a substantially U-shaped slot and receives said periphery of said severing blade without directly contacting said severing blade during said rotational movement of said severing blade.

8. The apparatus of claim 7 wherein a relationship between said severing blade, said substantially U-shaped slot, and said workpiece causes said workpiece to be pressed into said substantially U-shaped slot and sheared by providing resistance to said severing blade to assist in severing said workpiece.

9. An apparatus for severing a workpiece of a strong and resistant composition, said apparatus comprising:

a frame adapted for movement over a work surface;

a substantially flat cutting blade having a substantially circular periphery;

a platform, coupled to a drive and said cutting blade, for supporting said workpiece during movement of said workpiece thereover and beneath said cutting blade; and a guide plate mounted vertically in a plane with said cutting blade; and a plurality of rollers mounted on said platform via axle assemblies for rotational movement to facilitate movement of said workpiece over said platform during severing of said workpiece wherein said platform and said plurality of rollers move with said cutting blade through a path of travel for said severing of said workpiece, wherein at least one of said rollers on said platform define a slot in position to receive said periphery of said cutting blade therewithin, wherein said slot receives said cutting blade without directly contacting said cutting blade.

10. The apparatus of claim 9 wherein said slot is a substantially U-shaped slot and receives said periphery of said cutting blade without directly contacting said cutting blade during rotational movement of said cutting blade during said severing.

11. The apparatus of claim 10 wherein a relationship between said cutting blade, said substantially U-shaped slot, and said workpiece causes said workpiece to be pressed into said substantially U-shaped slot and sheared by providing resistance to said cutting blade to assist in severing said workpiece.

12. The apparatus of claim 9 wherein a plurality of rollers are rotationally mounted on a ramp mounted on a forward portion of said platform to assist in introducing said workpiece to said platform.

13. The apparatus of claim 9 wherein an engagement of said cutting blade with said workpiece during said severing assists in pulling said workpiece over said platform during said severing operation.

14. The apparatus of claim 9 wherein said at least one of said rollers that defines said slot is composed of brass.

15. The apparatus of claim 9 wherein said at least one of said rollers on said platform has said slot extending circumferentially thereabout operable to have said workpiece pressed into said slot by said cutting blade during said severing providing resistance to said cutting blade to assist in severing said workpiece.

* * * * *